US006488167B1

(12) United States Patent
Napp

(10) Patent No.: US 6,488,167 B1
(45) Date of Patent: Dec. 3, 2002

(54) FRAME WITH AN INSERT

(75) Inventor: Eckhard Napp, Grefrath (DE)

(73) Assignee: Anton Hurtz GmbH & Co. KG, Nettetal (DE)

( * ) Notice: Subject to any disclaimer, the term of this patent is extended or adjusted under 35 U.S.C. 154(b) by 0 days.

(21) Appl. No.: 09/700,689

(22) PCT Filed: Sep. 4, 1998

(86) PCT No.: PCT/EP98/05605

§ 371 (c)(1),
(2), (4) Date: Apr. 23, 2001

(87) PCT Pub. No.: WO99/61331

PCT Pub. Date: Dec. 2, 1999

(30) Foreign Application Priority Data

May 27, 1998 (DE) ..... 198 23 612

(51) Int. Cl.[7] ..... B65D 6/16
(52) U.S. Cl. ..... 220/4.31; 220/9.1

(58) Field of Search ..... 220/4.31, 4.33, 220/9.1, 9.2, 1.5 R

(56) References Cited

U.S. PATENT DOCUMENTS

| | | | | |
|---|---|---|---|---|
| 5,441,321 | A | 8/1995 | Karpisek | 294/68.21 |
| 5,588,693 | A | 12/1996 | Higginson et al. | 246/183 |
| 5,711,444 | A | 1/1998 | Meacham et al. | 220/6 |

FOREIGN PATENT DOCUMENTS

| | | |
|---|---|---|
| FR | 2690898 | 11/1993 |
| GB | 1331806 | 9/1973 |
| GB | 1361005 | 7/1974 |
| WO | WO 9521774 | 8/1995 |

*Primary Examiner*—Joseph M. Moy
(74) *Attorney, Agent, or Firm*—Pandiscio & Pandiscio

(57) ABSTRACT

A frame for pallets includes a plurality of frame bars that define a surface of the frame to which a frame insert is secured in a manner enabling the frame insert to be loaded transversely within a plane of the frame. The frame insert is form-fittingly interlocked with at least one frame bar transversely to the plane of the frame.

21 Claims, 5 Drawing Sheets

FRAME WITH AN INSERT

Figure 1A:
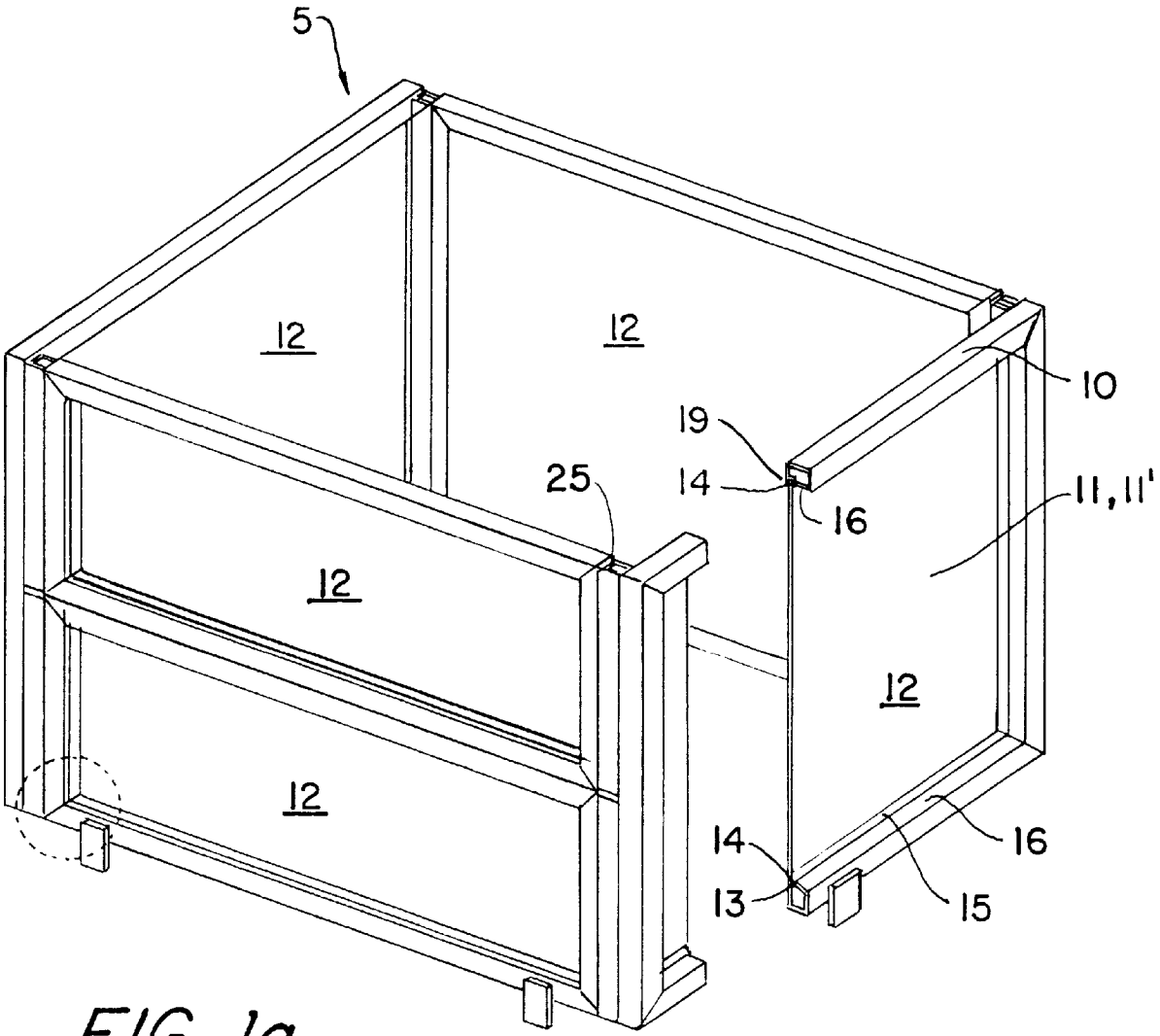

The invention relates to a frame, particularly a sidewall frame for pallets, composed of preferably plural frame bars that define a surface of the frame and to which a frame insert is secured in a manner that enables it to be loaded transversely within a plane of the frame.

A frame with the aforesaid features is generally known. The frame insert is secured in the frame such that after insertion it must be retained externally and is then riveted or welded. The joining techniques are performed in at least two work steps. Such frames are used in particular as side walls for pallets. These are articles that are manufactured on a relatively large scale. Under these circumstances, it is especially disadvantageous if high production costs have to be expended because of an onerous manufacturing process.

The object of the invention, by contrast, is to improve a frame with a frame insert having the aforesaid features in such a way that less time and expense are required for its production and production is simplified.

This object is accomplished in that the frame insert is form-fittingly interlocked with at least one frame bar transversely to the plane of the frame.

It is of importance for the invention that the structure is rendered stable merely by interlocking the frame insert together with the frame, which is composed of frame bars. No further welding or riveting of the frame insert to the frame is required, although this can be done as needed after interlocking to further improve the structural stability without any changes in the shapes involved Assembly is simplified by the fact that the frame insert can be mounted in the frame in one operation. Owing to this simplified assembly, the construction and the materials of the frame bars and the frame insert can be varied over a wide range at low cost The frame inserts can easily be pried out for cleaning or replacement without replacing the frame as well. The frame inserts are not damaged by mounting and removal and can be reused. This interlocking technique makes it possible to combine different materials without problems, particularly materials that can be welded only at widely different temperatures or not at all. The frame inserts can also be inserted and held in place with play, so that materials whose elasticity or expansion properties are different from those of the frame structure can be used as frame insert materials.

The frame can be implemented so that it is rectangular and its frame insert is interlocked with mutually parallel frame bars. The rectangular shape of the frame makes for especially easy mounting of the frame insert and enables various frames to be connected to one another, and, in the case of a palletizable container, to a rectangular pallet. Essentially, the frame insert need only be interlocked with opposite, parallel frame bars to hold it in place. The frame insert can easily be clicked into place and sits securely in either a one-part or a multi-part frame that can be made from a plurality of either straight- or miter-cut frame bars joined by weld seams or corner connectors.

It is advantageous to realize a frame in such manner that a frame bar is provided with a longitudinally extending locking recess in which the frame insert engages by an inserting edge. A longitudinally extending locking recess can be produced with little expenditure in a frame bar made, for example, of a hollow-profile section. If the locking recess extends over the entire frame bar, the arrangement of the insert in the frame can be varied if the insert is shorter than the frame bar. A frame insert that can be slid after being inserted in the frame can also be used. The inserting edge of the frame insert is easy to produce in this arrangement.

It is advantageous if the frame insert is a thin panel with insetting edges formed by tangent-bent portions. These can easily be made by bending or in a rolling process, for example in sheet stock. No complex shapes need be added.

In an advantageous embodiment of the frame, the locking recess is disposed on a frame-bar wall that faces a parallel frame bar. In this way, the frame insert can be mounted between the two frame bars. This makes it easier to obtain a good form-fitted seat. The structure has the same functionality, but its depth is smaller. This is especially desirable for palletizable containers because of the increased loading capacity gained from the smaller thickness of the frame sidewalls.

It is advantageous if the locking recess has the shape in cross section of a mating inserting edge which, if necessary, conforms to the adjacent surface of the frame bar comprising the locking recess. This ensures a good form-fit for the frame insert with the wall of the frame bar. The locking recess and the inserting edge meet to form a level surface. In this way, if goods to be carried should happen to shift inside a palletized container composed of these frame parts, they will not catch on any projections. There are no projections on any of the parts, and thus no water or dirt can collect. The creation of "puddling" areas is prevented. Simple cleaning is possible. In addition, a good visual impression is created.

The frame can be realized so that a wall belonging to one of the frame bars and comprising the locking recess makes an acute angle with a direction of insertion of the frame insert. Owing to the presence of an acute angle or an edge that slopes upwardly in the opposite direction to the direction of insertion of the frame insert, the frame insert is prevented from being pushed on through as it is inserted into the frame and a form-fit is created in the pushing direction. This is true in particular if the walls of two mutually parallel frame bars each make an acute angle with a direction of insertion of the frame insert, in a practically mirror-inverted arrangement. The distances between the frame bars at the two terminal edges of the confronting parallel walls are therefore different. The direction of insertion is preferably the direction in which the planes become narrower.

The frame is advantageously realized so that the inserting edges of the frame insert engage the locking recess under prestress. This provides additional retention, in addition to the form-fit of the locking recess, by increasing the static friction as a result of a pressure stress excited transversely to the loading direction. This stress can be adapted to the loading requirements concerned, for example in the shipping of goods. The use of a prestressed frame insert is especially advantageous in the case of metals or other relatively elastic materials.

It is advantageous that the inserting edges of the frame insert make an acute angle with the direction of insertion that is quantitatively greater than the acute angle of the frame-bar wall comprising the locking recess which they are to engage. This provides a simple way of generating. tension with the frame insert in the inserted state. This is advantageous for improving the retention of the frame insert, especially in the case of metal sheet.

An advantageous embodiment of the frame consists in that the frame insert is inserted by a planar or offset inserting edge into a locking recess realized as a push-in slot. This type of joint, particularly as a complement to the oblique walls on the insertion sides of the other frame bars of the frame, provides a way of securely positioning a frame insert, during the production of the frame, before the other edges of the frame insert are inserted. An offset inserting edge provides, in particular, a smooth edge at the transition from the frame insert to the frame bar.

It is advantageous if the frame insert only partially fills the surface of the frame. This makes it possible for the goods being carried to be ventilated or to be observed and monitored. In particular, a savings in material is possible and the gross weight is reduced. Furthermore, the assembly of the frame insert is facilitated by the lower press-in forces that need be applied.

The frame can be realized so that the frame insert is multi-part and its parts are distributed evenly over the surface of the frame. The multi-part nature of the frame insert makes for a wider range of variation in configuring the arrangement. If slidable frame inserts are used, the inserts can be arranged differently, as needed, even after assembly. An even distribution of the frame-insert parts over the surface of the frame creates uniform absorption of the forces that must be withstood during the use of the frame, e.g. as a palletized container. In addition, an appealing visual impression is ensured.

The frame insert advantageously is a hollow-profile section whose ends engage locking recesses of the frame bars. The realization of the frame insert as a hollow-profile section ensures good stability against both transverse and longitudinal forces, while keeping weight to a minimum, Materials usage is minimal, and the hollow-profile section can readily be fabricated in a proven manner by extrusion. When the frame insert is pressed in, the hollow-profile section also absorbs elastic deformation forces at the edges of the frame insert. Thus, constant, consistent prestressing of the frame insert is not necessary in every case, but instead, the hollow-profile section can serge to compensate for deviations resulting, for example, from the use of diverse materials or shapes. The hollow-profile section enables the frame with frame insert to be used as a thermally insulating wall for temperature-sensitive perishable goods. In addition, the use of multi-part frame inserts distributed over the surface of the frame is especially advantageous with this hollow-profile form, since the end edges can be interlocked securely even when the contact surface is small.

It is advantageous if the inserting edge of the frame insert is placed in an undercut in the frame bar. The undercut provides better retention to keep the frame insert from, slipping out against and transversely to the direction of insertion. In this case the acute angle does not necessarily have to be selected to achieve optimum retention, but can be adapted to simpler production conditions. During use of the frame with the frame insert, for example as a palletized container for carrying heavy, unwieldy goods, the franc inserts are secured against being pressed out by any shifting of the goods during transport.

If the frame insert is braced against its direction of insertion to prevent it from being pushed on through, this provides an advantageous embodiment of the frame. Otherwise, if, for instance, the frame-bar wall provided with the interlocking device is set at a low angle, the frame-insert part can accidentally be pushed on through the frame during assembly and fail to find support.

It is advantageous if the frame bars comprise supporting projections that extend behind the frame insert. Such supporting projections can easily be produced on frame hollow-profile sections by coextrusion, and can be shaped so that while ensuring effective retention, they do not present a hindrance to goods being slid into and moved about in a palletizable container composed of the frame and the frame inserts.

The frame can be realized so that the locking recesses keep the frame insert aligned with walls of the frame bars. This type of construction ensures that goods will not become caught on one another while being pushed into the container and that no hard-to-remove dirt can attach itself to the frame with frame insert.

It is advantageous if the frame bars and/or tile frame insert are made of metal or plastic. The use of metal or plastic ensures that palletizable containers constructed of these frames and the frame inserts are easy to clean and are safe and hygienic. Furthermore, metal or fiber-reinforced-plastic construction is, in particular, very resistant to the effects of external and internal forces. Plastic makes for very light-weight construction, which is especially suitable for air transport. It is also advantageous to construct a frame with frame insert of a combination of various materials. Due to the interlocking connection, an extremely wide variety of materials can readily and advantageously be used in combination as frame inserts and frames.

A further advantageous embodiment of the frame is realized if two or more frames are connected by a coupling/cooperative-coupling mechanism consisting of a channel section disposed on a frame outer wall of a first frame and a fillet disposed on a frame outer wall of a second frame and pushed into said channel section. This permits a widely variable mode of construction for different containers and frame structures. The construction of the coupling mechanism from channel sections and inserted fillets ensures stable retention and effective sealing against the ingress of moisture. The simplicity of assembly affords the possibility of stacking container frames to save space when the container is not needed for a time.

In order to produce a frame from plural frame bars with a frame insert in which the frame bars are connected to one other at their ends and the frame insert is mounted between the frame bars in such a way that it can be loaded transversely to the plane of the frame, a method as recited in claims 1 to 20 is proposed. The object is to find a simple, cost-effective joining method for producing frames with frame inserts.

This object is accomplished in that the frame insert is pushed between the frame bats transversely to the plane of the frame and is thereby interlocked with locking recesses of these frame bars in a transversely form-fitting manner. In contrast to welding or riveting, this interlocking can be achieved in one operation without expensive implements. The joining method of interlocking makes it possible to assemble a very wide variety of frame inserts and frames with one machine. This joining technique offers the particular advantage in production that the frame insert can be connected to the frame in a simple manner. No heightened requirements need be imposed on surface finish or on the choice and properties of the materials used in the elements for assembly. The method does not exclude the possibility of using other customary joining methods complimentarily and for better retention.

Figure 2A:
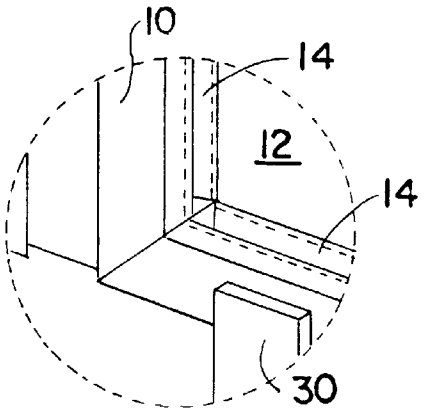
Figure 1B:
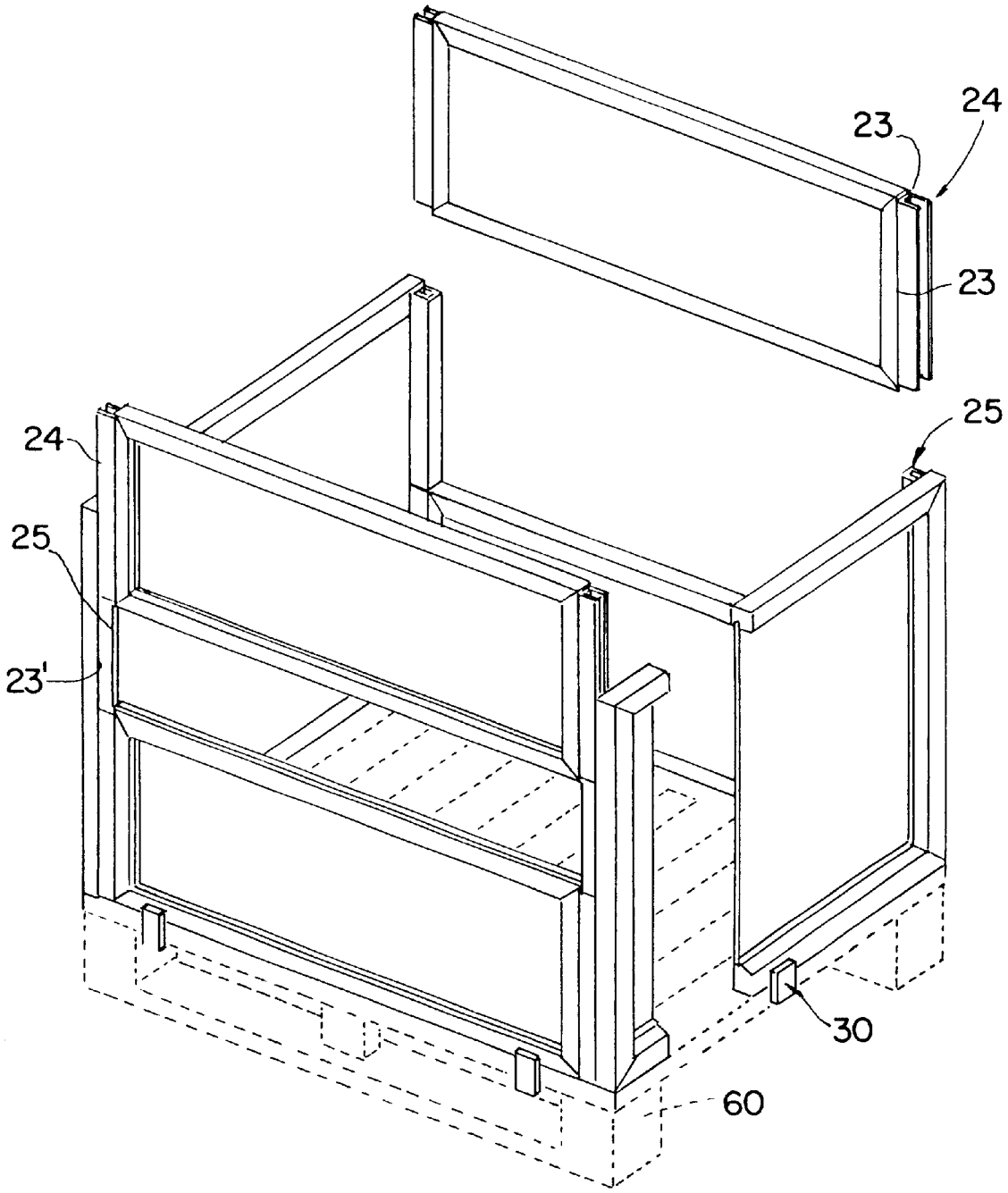
Figure 2B:
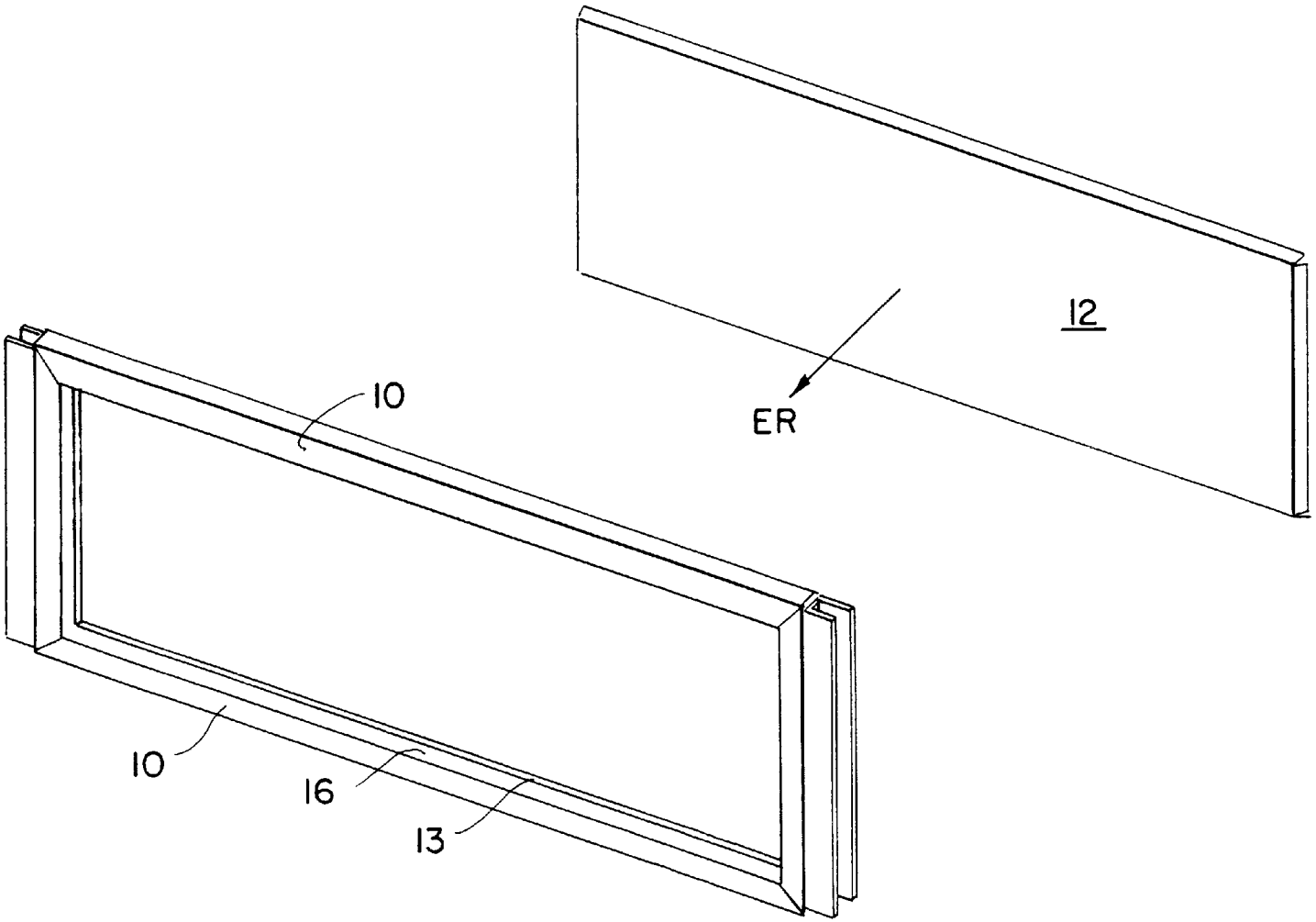
Figure 3A:
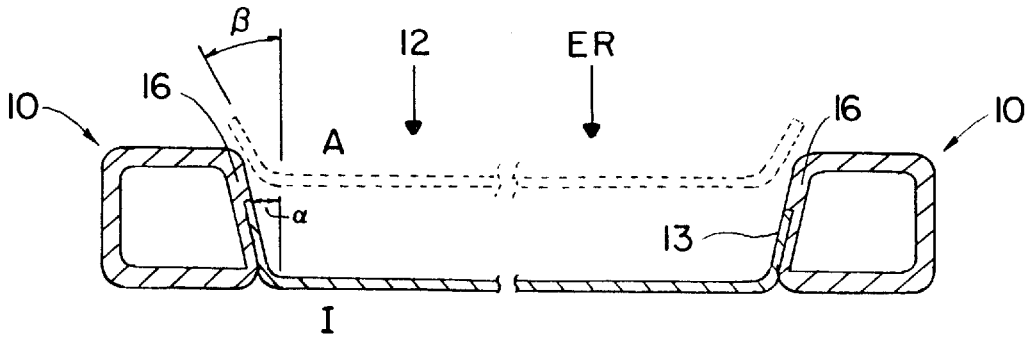
Figure 3B:
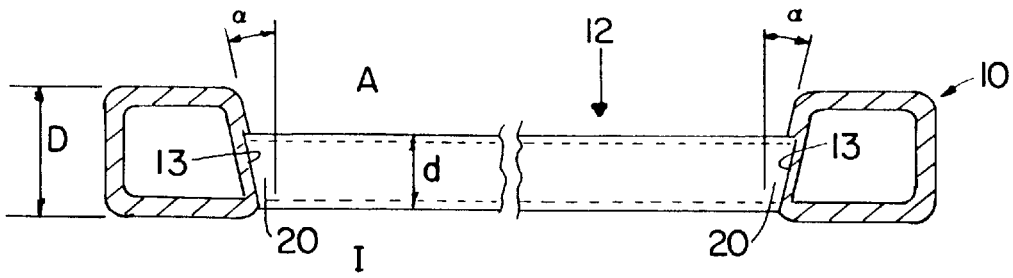
Figure 4A:
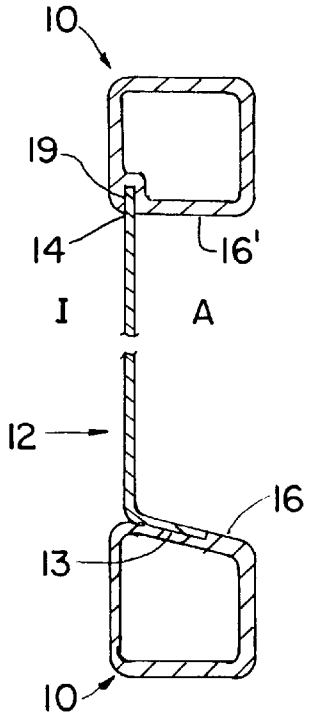
Figure 5:
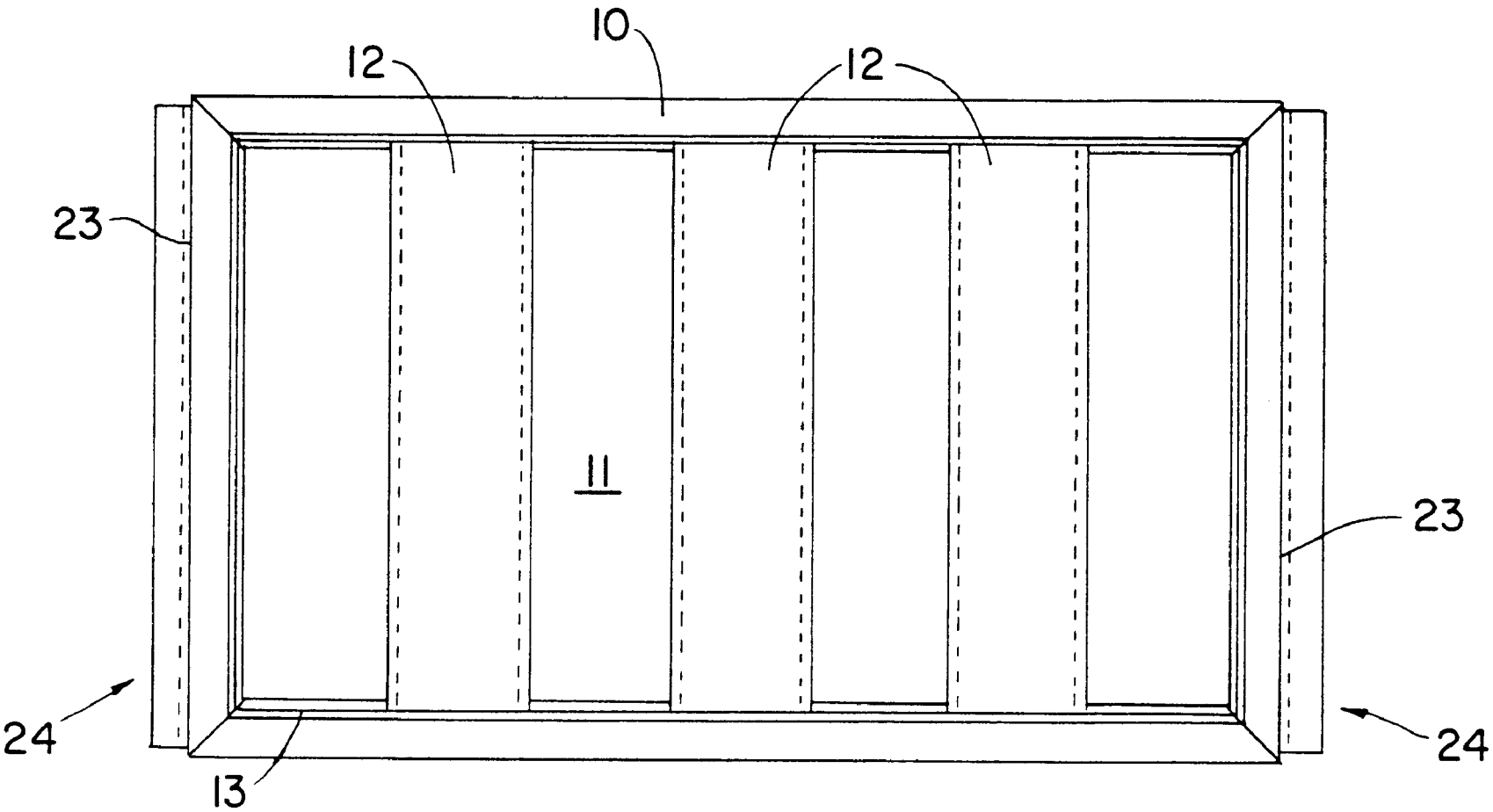

The invention is explained with reference to exemplary embodiments depicted in the drawings, which show:

FIG. 1*a* side walls belonging to a palletized container and composed of a frame and frame inserts, with a longitudinal section through two frame bars and one frame insert, FIG. 1*b* the assembly of a container made of plural frames, FIG. 2*a* an enlarged detail of a corner region of a frame insert inserted in a frame, FIG. 2*b* a frame insert and the frame, assembled from frame bars, prior to assembly, FIG. 3*a* a section through a prestressed frame insert held in a frame, FIG. 3*b* a hollow-profile section inserted in a frame, FIGS. 4*a, b* two sections through differently implemented interlocking connections, FIG. 5 a segmentally filled frame with coupling profile sections.

FIG. 1*a* shows a container 5 designed for pallets 60 (FIG. 1*b*) and composed of plural frames with frame inserts 12. In the embodiments shown here, the frames are rectangular. They are composed of miter-cut, hollow-section bars. A further option is to juxtapose the frame bars straight and then, as in the case of the miter-cut frame bars, to weld them together. Corner connectors can also be used. A side piece 55 consisting of a frame and a frame insert 12 is shown cut. It is shown in section again in FIGS. 3*a, b* and 4*a, b*, enlarged and in different embodiments.

The cross sections of the frame bars 10 are rectangular or comprise at the inner frame-bar wall 16 a slight gradient or an acute angle α (FIG. 3*a*) with respect to a direction of insertion ER (FIG. 2*b*) of the frame insert 12. The oblique wall 16 of the frame bar is realized with a locking recess 13 and the straight wall 16' of the frame bar comprises an insertion slot 19. The locking recesses 13 for oblique inner frame-bar walls 16 of frame bars 10 and straight inner frame-bar walls 16 of frame bars 10 with insertion slots 19 for the inserting edges 14 of the frame inserts 12 advantageously comprise undercuts or supporting projections (FIGS. 4*a, b*). The surface 11 of the frame is completely filled by a thin, oblong frame insert 12. In this case, the surface 11 of the frame in FIG. 1*a* coincides with the plane 11' of said frame. The direction ER of insertion of frame insert 12 is shown in FIGS. 2*b* and 3*a*. It preferably extends transversely to frame surface 11, in the direction of the taper formed by inner frame-bar walls 16. An end edge 14 of frame insert 12 sits in a locking recess 13, extending longitudinally over frame bar 10, of an inner frame-bar wall 16 of a rectangular frame bar 10. The insertion of a frame insert 12 into a frame with one straight frame-bar wail 16' and plural oblique frame-bar walls 16, shown in FIGS. 4*a, b*, is effected by first insetting the inserting edge 14 of frame insert 12 that is intended for straight wall 16' into insertion slot 19 and then snapping the remaining inserting edges 14 into the locking recesses 13 of oblique frame-bar walls 16.

For improved and form-fitting retention of a container on the pallet 60, tabs 30 are mounted on frame bars 10 resting on pallet 60 in such a way that they embrace pallet 60 and thereby protect against lateral displacement and ensure a form-fit for the container 5.

FIG. 1*b* shows how the side walls composed of the frame and frame insert 12 are assembled by means of a coupling/cooperative coupling mechanism. Said mechanism consists of channel sections 24 and fillets 25 that are disposed longitudinally on outer surfaces 23, 23' of frame bars 10. In this way, frame parts comprising a channel section 24 and frame parts with a fillet 25 can be fit together to form a frame-based container 5 that can be configured in a variety of ways.

FIG. 2*a* is an enlarged detail of a corner region of container 5 from FIG. 1*a*. At the corner of mounted frame insert 12, said corner being composed of two frame bars 10, there is a split into two inserting edges 14 that extend along the frame bars 10. In this type of construction, there is at the corner an expanded end portion that leaves space for the connecting seam of the frame bars 10, e.g. a weld seam.

FIG. 2*b* schematically illustrates the insertion of a frame insert 12 into a frame. All the inserting edges 14 are realized as tangent-bent and lock simultaneously into the locking recesses 13 of the inner, oblique frame-bar walls 16 of the frame.

FIG. 3*a* shows in more detail the insertion of a frame insert 12 in the form of a sheet with its edges bent at an angle β into a frame made from frame bars 10 with bent frame edges 14 at walls 16 disposed at angle α. The direction of insertion is denoted by ER. Angle a is smaller than angle β. In this way, frame insert 12 is placed under tension when inserted in the frame. This provides a better grip and thus greater stability and an improved form-fit, in addition to that created by oblique frame-bar walls 16 and locking recesses 13, to prevent frame insert 12 from slipping through.

FIG. 3*b* shows a hollow-profile section inserted by its end 20 into a frame bar 10. The thickness d of the hollow-profile section is less than the thickness D of the frame bars 10. The length of locking recesses 13 on oblique frame-bar walls 16 corresponds to a projection of thickness d of the hollow-profile section onto frame-bar wall 16. The surface of the inside I of the frame is therefore flush with frame insert 12 and the profile section can be restrained against movement toward the outside A of the frame by locking recesses 13.

Figure 4B:
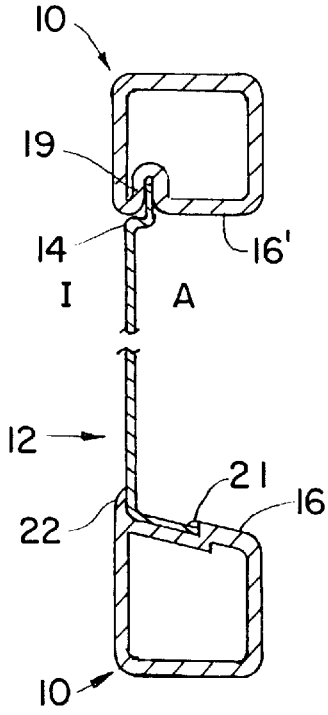

FIGS. 4*a, b* shows two preferred designs of oppositely disposed frame bars 10 with one oblique frame-bar wall 16 and one straight frame-bar wall 16'. The straight frame-bar wall 16 comprises an insertion slot 19, into which is inserted a planar (FIG. 4*a*) or offset (FIG. 4*b*) inserting edge 14 of a frame insert 12. The offset inserting edge 14 offers the advantage of creating a smoother transition to the inside I of the frame. Said smooth transition is advantageous when the container 5 fashioned from the frame is to hold sensitive goods that must not become caught or come into contact with dirt or water that has collected at the edges.

Also illustrated, in addition to the simple locking recess 13 in an oblique frame-bar wall 16 of a frame bar 10, is an embodiment comprising a supporting projection 22 that extends behind frame insert 12 to keep it from slipping through. Particularly in the case of non-prestressed frame-insert sheets 12, it is advantageous to provide the locking recess 13 with additional security against slip-out in the form of an undercut 21 in the oblique frame-bar wall 16 of frame bar 10. It is advantageous to arrange a frame bar 10 comprising a straight inner frame-bar wall 16' in the frame in such a way that during assembly, frame insert 12 is first pushed into insertion slot 19 and then can be snapped under tension into locking recesses 13. However, it is just as conceivable for all four sides to be snapped in by force by their sloped, bent edges 14, as shown in FIGS. 2*b* and 3*a*.

FIG. 5 shows a multi-part frame insert 12 whose individual parts are evenly distributed over the surface 11 of the frame and can be engaged in locking recesses 13 in mutually opposite, parallel frame bars 10. Formed-on snap-in edges can be used. Disposed on the outside 23 of the frame bars 10 are channel sections 24. They serve, in combination with the fillets 25, as described hereinabove, as a coupling/cooperative-coupling mechanism for constructing palletizable containers 5 from frames with frame inserts 12. The frame walls or side walls are secured against falling apart by conventional means, e.g. strapping or locks.

What is claimed is:

1. A frame comprising a sidewall frame for pallets, said sidewall frame comprising plural frame bars (10) defining a frame plane (11'), a frame insert (12) disposed within said frame plane (11') and fastened to said frame bars (10) and which can be loaded transversely to said frame plane, wherein said frame insert (12) is interlocked form-fittingly with at least one frame bar with overcoming of press-in forces oriented transversely to the frame plane, said frame insert being braced by said frame against a direction (ER) of insertion to prevent said frame insert from being pushed on through, and a wall (16) belonging to one of said frame bars (10) and comprising a locking recess (13) and making an acute angle (α) with the direction (ER) of insertion of said frame insert (12).

2. The frame of claim 1 wherein said frame insert is rectangular and is interlocked with mutually parallel frame bars (10).

3. The frame of claim 1 wherein said frame insert (12) only partially fills said frame plane (11).

4. The frame of claim 3 wherein said frame insert (12) is multi-part and its parts are evenly distributed over said frame plane (11).

5. The frame of claim 1 wherein said frame insert (12) is a hollow-profile section with ends (20) engageable with the locking recesses (13) in said frame bars (10).

6. The frame of claim 1 wherein said frame bars (10) and said frame insert (12) are each made of a selected one of metal and plastic.

7. The frame of claim 6 wherein two or more of the frames are connected by means of a coupling/cooperative-coupling mechanism consisting of a channel section (24) disposed on a frame outer wall (23) of a first of the frames and a fillet (25) disposed on a frame outer wall (23' ) of a second of the frames and pushed into the channel section.

8. A sidewall frame for pallets, said sidewall frame comprising plural frame bars (10) defining a frame plane (11'), a frame insert (12) disposed within the frame plane (11') and fastened to said frame bars (10) and which is loaded transversely to said frame plane (11'), wherein said frame insert (12) is interlocked form-fittingly with at least one of said frame bars (10) with overcoming of press-in forces oriented transversely to the frame plane (11'), wherein said at least one frame bar (10) is provided with a hollow interior and locking recess (13) facing a parallel one of said frame bars (10), the locking recess being adapted to receive an insertion edge (14) of a slanting surface of said frame insert (12), and said frame insert (12) is supported by the frame opposite to the direction of insertion (ER) against pushing through, for which said one frame bar (10) is provided with a supporting projection (22) gripping said frame insert (12).

9. The frame of claim 8 wherein said locking recess (13) of said frame bar (10) extends longitudinally and said frame insert (12) mates therewith by an inserting edge (14) with said locking recess (13).

10. The frame of claim 9 wherein said frame insert (12) is a thin plate with the inserting edge (14) formed by tangent-bent portions (15).

11. The frame of claim 10 wherein said locking recess (13) is, disposed on a frame-bar wall (16) that faces a parallel frame bar (10).

12. The frame of claim 11 wherein said locking recess (13) has the shape in cross section of a mating inserting edge (14) which conforms to an adjacent surface of said frame bar (10) comprising said locking recess (13).

13. The frame of claim 12 wherein the walls (16) of two mutually parallel frame bars (10) each make an acute angle (α) with a direction (ER) of insertion of said frame insert (12) in a substantially mirror-inverted arrangement.

14. The frame of claim 9 wherein said inserting edge (14) of said frame insert (12) engages said locking recess (13) under prestress.

15. The frame of claim 13 wherein said inserting edges (14) of said frame insert (12) form with the direction (ER) of insertion thereof an acute angle (β) that is quantitatively greater than the acute angle (α) of the associated wall (16) belonging to the frame bar (10) and comprising the locking recess (13).

16. The frame of claim 8 wherein said frame insert (12) is inserted by a planar inserting edge (14) into the locking recess (13) implemented as an insertion slot (19).

17. The frame of claim 9 wherein said inserting edge (14) of said frame insert (12) is inserted in an undercut (21) in said frame bar (10).

18. The frame of claim 13 wherein said frame insert (12) is held flush with the walls (16) of said frame bars (10) by the locking recesses (13).

19. A method for producing a frame from plural frame bars (10), with a frame insert (12), in which the frame bars (10) are connected to one another at their ends and the frame insert (12) is mounted between the frame bars (10) to make a sidewall frame for pallets, wherein the frame bars define a frame plane (11') in which is disposed the frame insert (12), which is secured to the frame bars (10) and can be loaded transversely to the frame plane (11'), and wherein the frame insert (12) is pushed between the frame bars (10) with the overcoming of press-in forces oriented transversely to the frame plane, and is interlocked form-fittingly transversely to the frame plane (11') with a locking recess (13) in at least one frame bar (10), the frame insert (12) being braced by the frame against its direction (ER) of insertion to prevent the frame insert from being pushed on through, and a wall (16) belonging to one of the frame bars (10) and comprising a locking recess (13) forming an acute angle (α) with the direction (ER) of insertion of the frame insert.

20. The method in accordance with claim 19 wherein the wall (16) is provided with a supporting projection (22) that extends over the frame insert (12) when the frame insert is pushed into the locking recess (13).

21. A sidewall assembly for pallets, said sidewall assembly comprising multiple frame bars (10) surrounding a frame plane (11'), a frame insert (12) located in the frame plane (11'), said frame insert being fastened to the frame bars (10) and fixed across the frame plane (11'), wherein at least one frame bar (10) overcomes inward press-in forces applied normal to the frame plane, each of said frame bars (10) being provided with a hollow interior and a locking recess (13) facing a parallel frame bar (10), the locking recess (13) being adapted to receive an insertion edge (14) of a slanting surface (15) of said frame insert (12), and said frame insert (12) is supported by the frame opposite to a direction of insertion (ER) against pushing through, for which said frame bar (10) is provided with a supporting projection (22) gripping said frame insert (12).

* * * * *